US006205692B1

(12) United States Patent
Kite

(10) Patent No.: US 6,205,692 B1
(45) Date of Patent: Mar. 27, 2001

(54) THREE-DIMENSIONAL DECORATIVE OBJECT

(75) Inventor: Steven Kite, Wilmette, IL (US)

(73) Assignee: Planter, Inc., Chicago, IL (US)

( * ) Notice: Subject to any disclaimer, the term of this patent is extended or adjusted under 35 U.S.C. 154(b) by 0 days.

(21) Appl. No.: 09/234,539

(22) Filed: Jan. 21, 1999

(51) Int. Cl.[7] ..... G09F 19/12; A47G 1/06

(52) U.S. Cl. ..... 40/615; 40/737; 40/781; 40/798

(58) Field of Search ..... 40/737, 798, 799, 40/772, 781, 773, 615

(56) References Cited

U.S. PATENT DOCUMENTS

| | | | | |
|---|---|---|---|---|
| 370,133 | * | 8/1887 | Egginton | 40/737 |
| 737,124 | * | 8/1903 | Manor | 40/737 |
| 912,329 | * | 2/1909 | Sterrick | 40/737 |
| 1,032,515 | * | 7/1912 | Sterrick | 40/737 |
| 1,037,607 | * | 9/1912 | Floto | 40/124.5 |
| 3,494,056 | | 2/1970 | Elzer . | |
| 4,071,385 | | 1/1978 | Kuris . | |
| 4,125,655 | | 11/1978 | Kanzelberger . | |
| 4,126,500 | | 11/1978 | Palanos . | |
| 4,190,691 | | 2/1980 | Kramer . | |
| 4,209,486 | | 6/1980 | Ross . | |
| 5,100,732 | | 3/1992 | Benefiel . | |
| 5,415,902 | | 5/1995 | Stryker, Jr. . | |
| 5,533,288 | * | 7/1996 | Lambert | 40/773 |

OTHER PUBLICATIONS

Stone Image ForSight 2000 Specification Product Catalog.
Vantage Point Award & Gifts Quantity of Relevant Pages.
Johnson Plastics 1995 Catalog Quantity of Relevant Pages.
North American Walnut Old Master Quantity of Relevant Pages Pre 1990.
The Engravers Journal vol. 9, No. 8 Mar./Apr. 1984 Quantity of Relevant Pages.

* cited by examiner

*Primary Examiner*—Joanne Silbermann
(74) *Attorney, Agent, or Firm*—Laff, Whitesel & Saret, Ltd.

(57) ABSTRACT

A decorative object including a groove, such as a grooved border or other indicia, with a rounded apex and well-defined sidewalls, formed in the back surface of the object. The back side of the object is painted a first color and the grooved border is painted a second different or contrasting color to give the illusion of a frame made of metal, stone or some other material that is embedded in the object. The illusion of an embedded frame gives the object a three-dimensional visual quality.

12 Claims, 3 Drawing Sheets

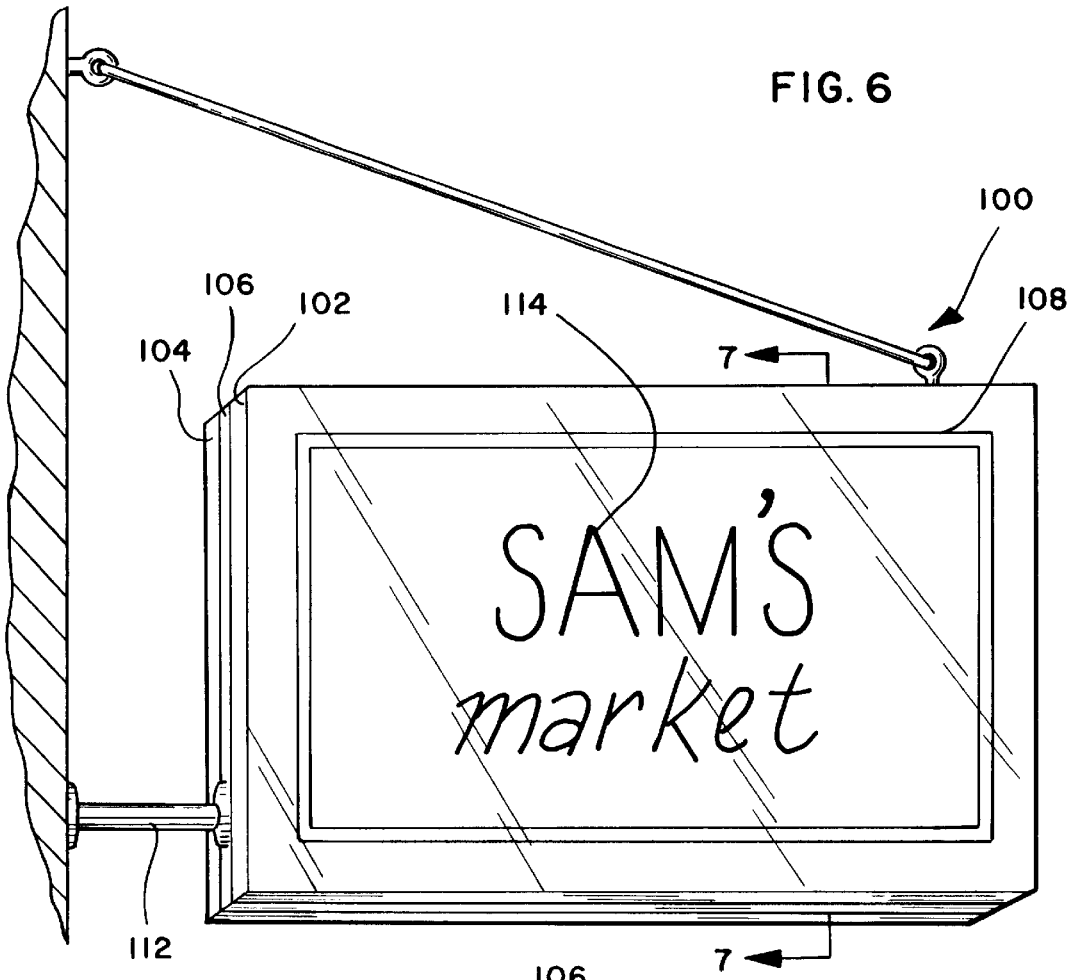
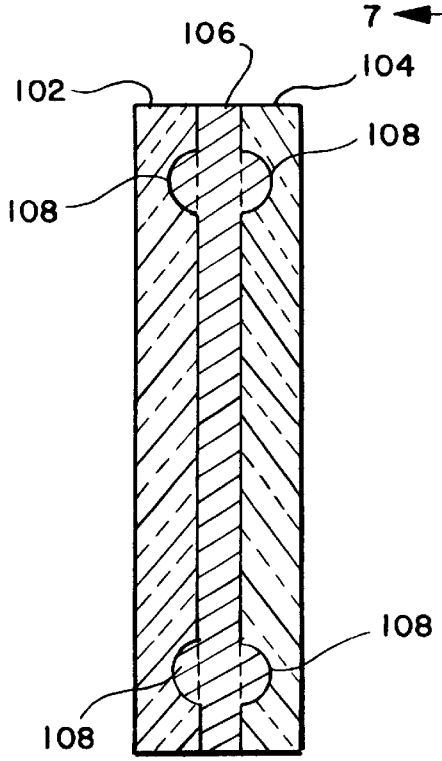
FIG. 7

THREE-DIMENSIONAL DECORATIVE OBJECT

FIELD OF THE INVENTION

The present invention relates to decorative objects. More particularly, it relates to decorative objects with features that appear to float in the object giving the object a three-dimensional visual quality, particularly useful in display plaque inserts.

BACKGROUND INFORMATION

Decorative award plaques are often given as recognition of an achievement. Usually, these plaques include indicia such as a symbol, picture, or device, the recipient's name, and other pertinent information. Other uses for such plaques may include personalized desk sets, and works of art.

These decorative plaques generally include a base, which is usually made of wood, and a plate or plaque insert, which is attached to the base. Indicia can be engraved or silk-screened onto the plaque insert. The plaque insert may be attached to the front surface of the base or it may be inserted into a cavity in the front of the base. Preferably, the front surface of the plaque insert is flush with the front surface of the base. Prior art decorative plaques typically present a two-dimensional visual appearance.

SUMMARY OF THE INVENTION

The present invention comprises a decorative object with unique three-dimensional appearing features that seem to float in the object. A decorative object according to the present invention is particularly useful as a display plaque insert, although it can also be used as signage or other decorative objects. A plaque insert according the present invention can be used with a base to provide a display plaque.

The plaque insert has a first side back surface and a second side front surface. The base has a front side and a back side and a cavity in its front side that is complementary in shape to the insert for receiving the plaque insert. The plaque insert is fitted in the cavity and is attached to the base with the back surface of the plaque insert adjacent to the front side of the base.

The plaque insert includes a groove in the back surface of the insert. The back surface and groove of the insert are painted different or contrasting colors to give the plaque insert a three-dimensional appearance, as explained below. Preferably, the groove has a half-moon cross-section. In another preferred embodiment, the groove has a rounded apex and well-defined sidewalls. The groove may run around the perimeter of the plaque insert to form a grooved border or it may form a three-dimensional design, symbol or word, such as indicia on the display plaque or on signage.

Preferably, a third layer of paint covers the groove layer and insert back surface layer of paint. The insert is transparent, in that at least the apex of the groove is visible through the front surface of the plaque insert, and indicia may be engraved or silk-screened on the front or back surface of the insert.

In an alternative embodiment, the plaque insert is completely transparent and the groove is painted a color that contrasts with the color of the base. Because the plaque insert is completely transparent, the color of the base is visible through the plaque insert and the painted groove appears to float in the plaque insert giving the insert a three-dimensional visual quality without painting the back surface of the plaque insert.

In another alternative embodiment, the transparent plaque insert is tinted a first color and the groove is painted a different or contrasting color from the plaque insert tint. In this embodiment, the painted groove again appears to float in the plaque insert giving the insert a three-dimensional visual quality without painting the back surface of the plaque insert.

In still another embodiment, the decorative object is used in a sign. This embodiment may comprise two decorative objects, each having a painted groove in the back surface thereof, and a base between the two decorative objects. The decorative objects are mounted on the base with their back surfaces adjacent to the base. In this manner, the painted groove, which appears to float in the decorative object, can be seen from either side of the sign.

A process for making the decorative object of the present invention, such as a three-dimensional plaque insert, is also disclosed. The process comprises the steps of applying a first layer of paint to the back surface of the object, forming a groove in the back surface of the object and applying a second different or contrasting layer of paint to the groove. The process may further comprise the step of applying a third layer to the object back surface and groove covering the first and second layers of paint.

The groove may be formed by routing the groove into the back surface of the object. Preferably, the groove is a grooved border having a rounded apex and well-defined sidewalls. Routing forms the rounded apex in the grooved boarder closest to the front surface of the object opposite the back surface.

Alternatively, the process may comprise the steps of forming a groove in the back surface of the object and applying a layer of paint to the inside of the groove. The object is completely transparent so that the color of the base shows through or the object is tinted and the layer of paint is different or contrasting from the color of the base or the color of the tinted object.

BRIEF DESCRIPTION OF THE DRAWINGS

FIG. 6 is a plan perspective view of a three-dimensional decorative sign according to the present invention;

FIG. 7 is a cross-sectional view of the sign shown in FIG. 6.

DETAILED DESCRIPTION OF THE PREFERRED EMBODIMENT

Figure 1:
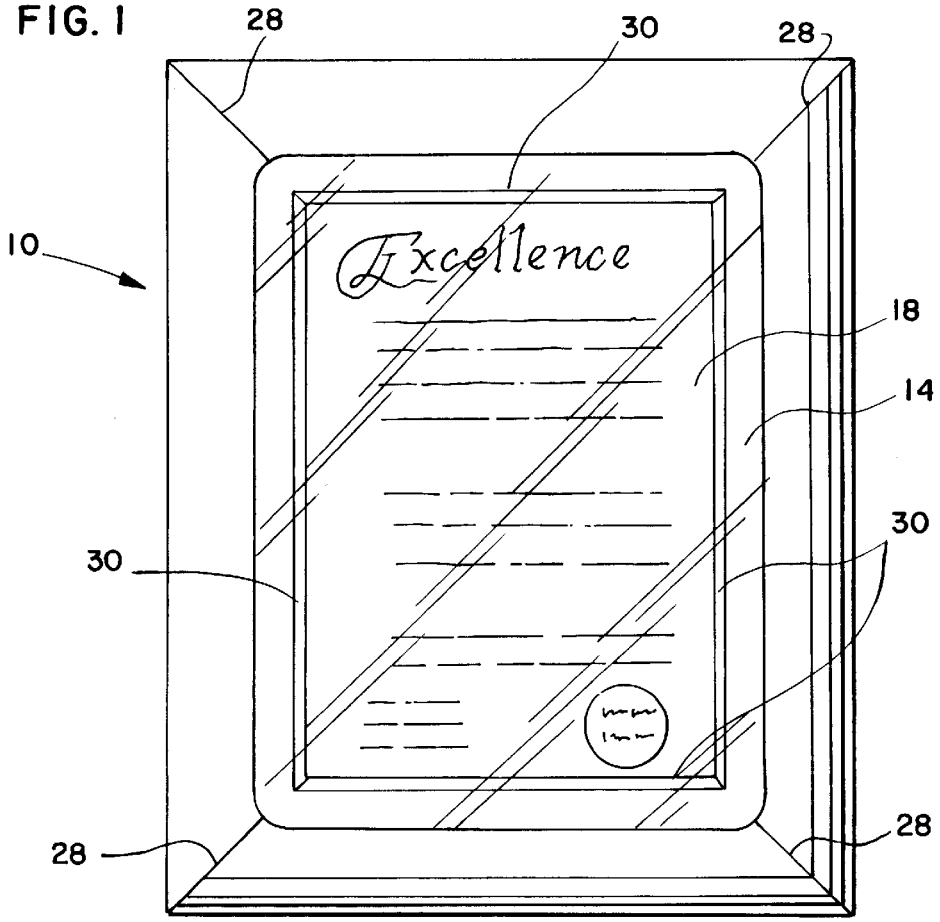
FIG. 1 is a front plan view of a display plaque with indicia, shown in portrait orientation according to the present invention.

In accordance with the present invention, a three-dimensional decorative object is described that provides distinct advantages when compared to those of the prior art. The present invention comprises a three-dimensional decorative object with features that appear to float in the object giving the object a three-dimensional visual quality. Three-dimensional objects of this type are particularly useful as display plaque inserts. The invention can best be understood with reference to the accompanying drawing figures.

Referring now to the drawings, a decorative plaque, generally designated by reference numeral 10, includes a base 12 and a decorative object such as a plaque insert 14. The plaque insert 14 includes a back surface 16 on a first side of the plaque insert 14 and a front surface 18 on a second side of the plaque insert 14. The front or back surface 18, 16 may include indicia 20 such as words, symbols and/or designs. The indicia 20 can be engraved or printed on the front or back surface 18, 16 such as by silk-screening. Preferably, the plaque insert 14 is made of a sheet of transparent acrylic, such as LUCITE or a similar plastic material.

The plaque insert 14 includes a groove 30 in the back surface 16 of the insert 14. Preferably, the groove 30 is half-moon shaped in cross-section and runs around the perimeter of the plaque insert 14 forming a grooved border. Alternatively, the groove 30 may form a three-dimensional design, symbol or word or it may form the indicia 20.

In another preferred embodiment, the groove 30 has a rounded apex 32 and well-defined sidewalls 34. The well-defined sidewalls 34 comprise substantially straight walls extending perpendicularly from the back surface 16 of the plaque insert 14 to the rounded apex 32. The rounded apex 32 is closest to the front surface 18 of the insert 14. Preferably, the plaque insert 14 is at least ⅛" thick and the groove 30 is at least 1/16" deep and 3/16" wide. Of course, plaques of different sizes can be made with different size grooves without departing from the spirit and scope of this application as set forth in the appended claims.

The plaque insert 14 further comprises a first layer of coating, such as air-dried or UV-cured, silk-screen ink, that is acrylic compatable, covering the back surface 16 of the plaque insert 14 to provide a relatively uniform background or design and a second layer of coating, of a different or contrasting color from the first layer of coating, covering the inside of the groove 30, giving the plaque insert 14 a three-dimensional visual quality. Preferably, the first and second layers of coating are opaque and plaque insert 14 is transparent enough so that at least the apex 32 of the groove 30 is visible through the front surface 18 of the plaque insert 14. In the preferred embodiment, the plaque insert 14 is completely transparent. The coated groove 30 then gives the illusion of a piece of metal, stone or some other material that is embedded within the plaque insert 14.

In the preferred embodiment, the layer of coating in the groove 30 may be simulated brass, stone or another decorative pattern or color. The layer of coating on the back surface 16 of the plaque insert 14 may be deep black, simulated marble, or another decorative color or pattern. A third layer of coating may also be included covering the first-mentioned and second-mentioned layers of coating to protect the latter from chipping, scratching, peeling, etc.

The base 12 has a front surface 22 and a back surface 24. The front surface 22 includes a cavity 26 for receiving the plaque insert 14. The cavity 26 is complementary in shape to the plaque insert 14 such that the plaque insert 14 fills the entire cavity 26. The cavity 26 depth is such that the front surface 18 of the plaque insert 14 is flush with the front surface 22 of the base 12 when the plaque insert 14 is positioned in the cavity 26. In the preferred embodiment, the cavity is ⅛" deep.

The base 12 can include beveled edges 28 to enhance its appearance. Preferably, the base 12 is made of wood, such as walnut. Alternatively, the base 12 may be made of a plastic material having a decorative finish such as gloss black or simulated stone.

In a preferred embodiment, the base 12 comes in three sizes, 7"×9", 8"×10" and 9"×12". Accordingly, the plaque insert 14 also comes in three complementary sizes, 5"×7", 6"×8" and 7"×10", respectively. The plaque insert 14 is positioned in the cavity 26 and attached to the base 12, such as by adhesive. Of course, plaques of different sizes and shapes can be made without departing from the spirit and scope of this application as set forth in the appended claims.

Figure 2:
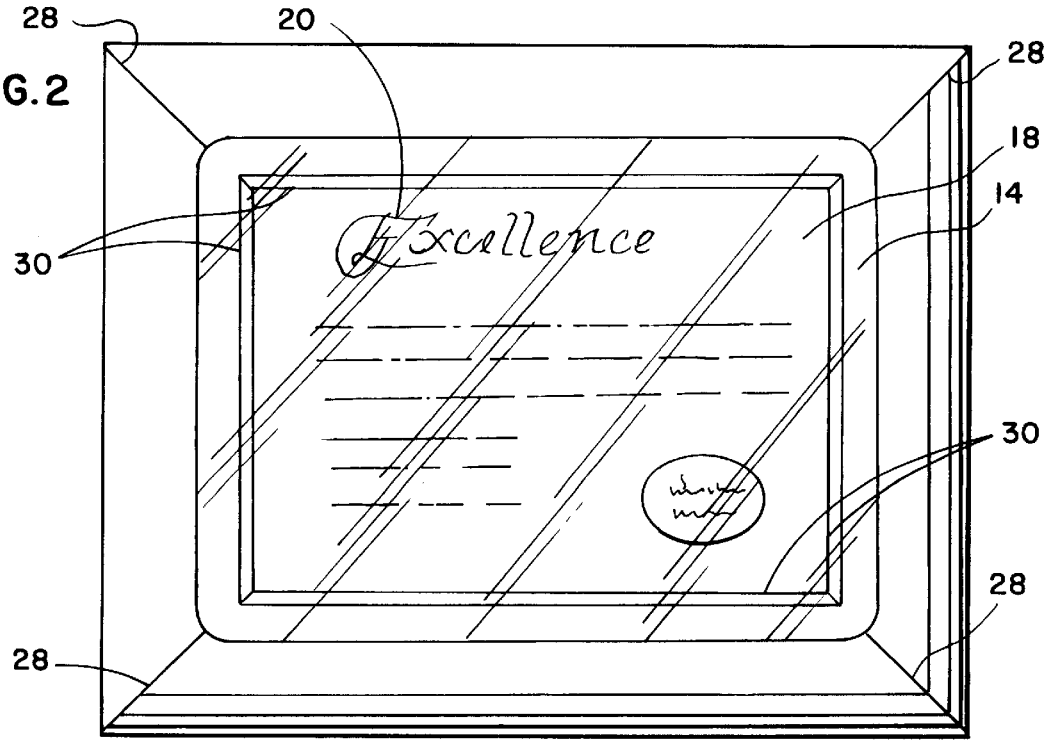
FIG. 2 is a front plan view of another display plaque with indicia, shown in landscape orientation according to the present invention.
Figure 3:
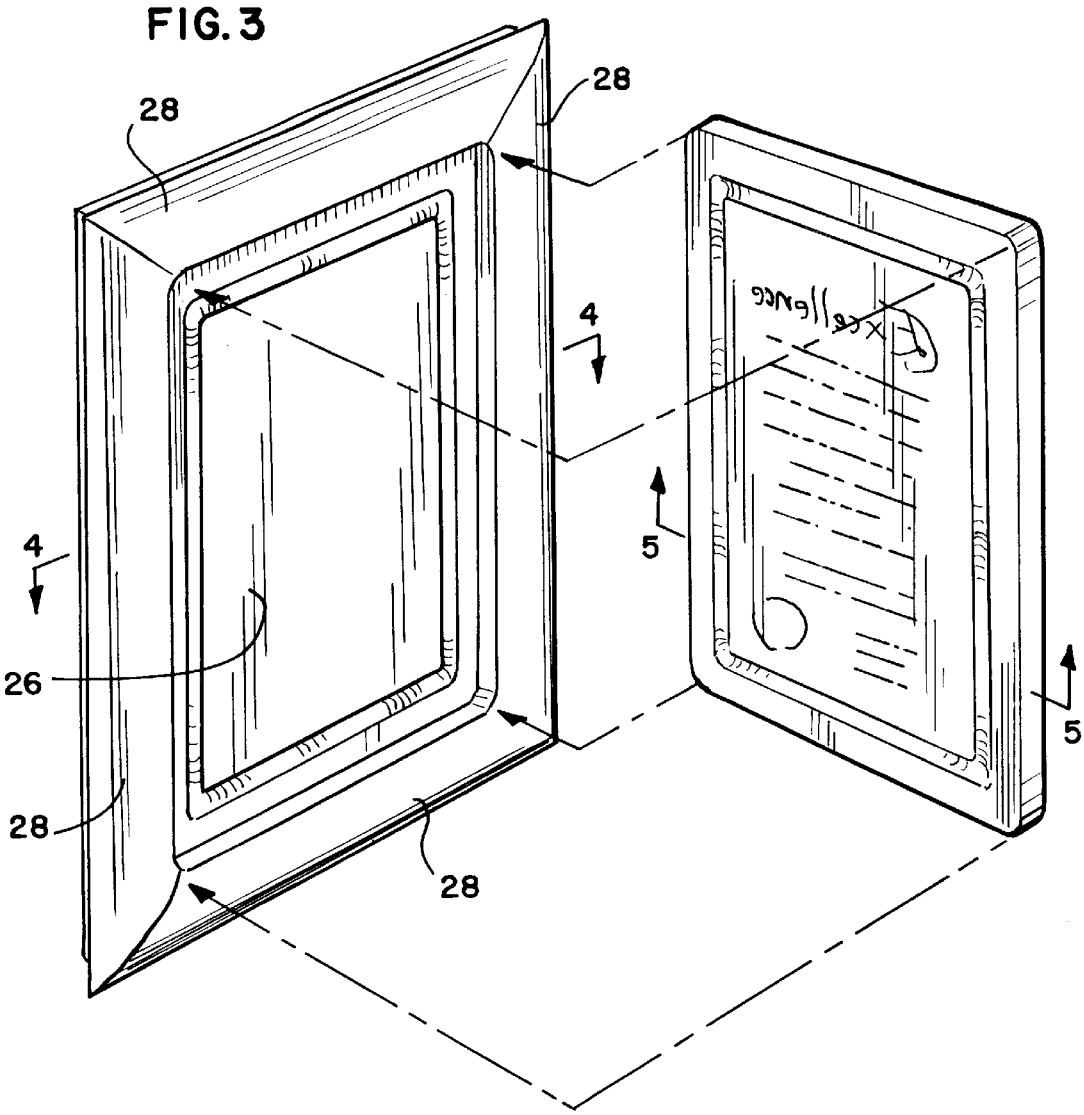
FIG. 3 is an exploded view of the display plaque of FIG. 1.
Figure 4:
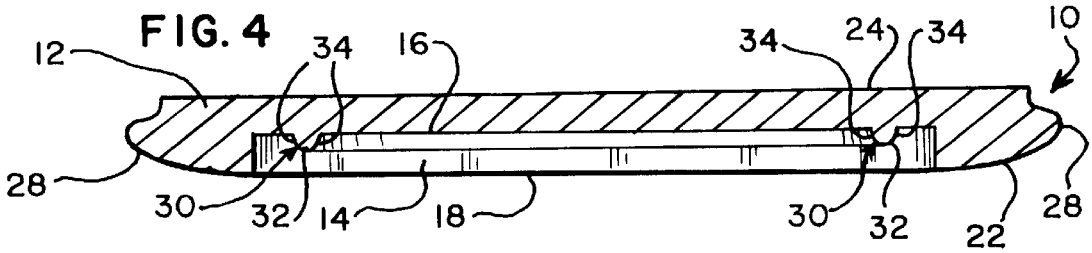
FIG. 4 is a cross-sectional view of the display plaque of FIG. 1.
Figure 5:
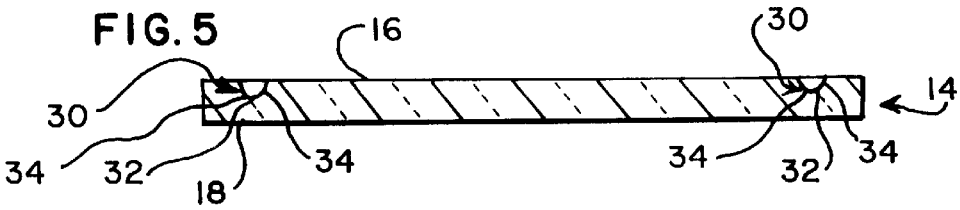
FIG. 5 is a cross-sectional view of the plaque insert shown in FIG. 1.

The indicia 20 may be applied to the front or back surface 18, 16 of the plaque insert 14 in either portrait (see FIGS. 1 and 3) or landscape (see FIG. 2) orientation. The back surface 24 of the base 12 may have tabs (not shown), in various locations, for hanging the plaque 10 so that the plaque 10 can easily be mounted on a wall in either portrait or landscape orientation.

As shown in FIGS. 6 and 7, a decorative object according to the present invention can be used in an internal or external sign 100, such as the type used by a typical storefront business. The sign 100 comprises two decorative objects 102 and 104 and a base 106.

Similar to the plaque insert 14 described above, each decorative object 102, 104, includes a groove 108 in the back surface of the object 102, 104. A first layer of coating, such as paint, covers the backside of the object 102, 104 to provide a relatively uniform background or design. The decorative object 102, 104 is transparent, in that at least the apex of the groove is visible from the front surface of the object. A second layer of coating, of a different or contrasting color from the first layer of coating, covers the inside of each groove 108, giving the sign 100 a three-dimensional visual quality.

The decorative objects 102, 104 are mounted on the base 106 with their back surfaces adjacent to the base 106. Alternatively, the base 106 can be excluded and the two decorative objects 102, 104 can be mounted together with their back surfaces adjacent to each other. In the preferred embodiment, the base 106 and decorative objects 102, 104 are substantially the same size and shape. The sign 100 further includes indicia 114 such as words, symbols, designs, etc. The sign 100 can be mounted onto a building exterior 110 using conventional mounting means 112. Alternatively, the sign 100 can comprise a single decorative object mounted onto a building exterior 110 or wall with its back surface adjacent to the building exterior 110.

In making a three-dimensional plaque insert 14 (or decorative object 102, 104) according to the present invention, a first layer of coating, such as paint, is applied to the back surface 16 of the plaque insert 14 to provide a relatively uniform background or design for the plaque insert 14. In one preferred embodiment, the groove 30 includes a rounded apex 32 and well-defined sidewalls 34 formed in the back surface 16 of the plaque insert 14. The rounded apex 32 of the groove 30 is formed closest to the front surface 18 of the plaque insert 14. Preferably, the groove 30 is routed into the plaque insert 14. Alternatively, the plaque insert 14 can be formed with a groove 30 such as by injection molding or other manufacturing process.

After the groove 30 is formed, a second layer of coating is applied inside the groove 30, which second layer of coating is visible from the front surface 18 of the plaque insert 14. The second layer of coating may be of such a color or have a pattern that simulates brass, stone or another decorative pattern or color. The second layer of coating is a different or contrasting color from the first layer of coating. A third layer of coating is applied over the first and second layers of coating to protect the first and second layers.

Alternatively, the back surface 16 of the plaque insert 14 can be left uncoated, allowing the base 12 to be visible through the front surface 18 of the plaque insert 14 when the insert 14 is held in the cavity 26. The inside of the groove 30 is coated with a different or contrasting color from the color of the base 12. Because the plaque insert 14 is transparent, the color of the base 12 will be visible through the plaque insert 14 and the coated groove 30 will appear to float in the plaque insert 14 giving the plaque insert 14 a three-dimensional visual quality.

In another alternative embodiment, the plaque insert 14 (or decorative object 102, 104) is tinted a first color and is transparent enough so that at least the apex 32 of the groove 30 is visible through the front surface 18 of the insert 14. The inside of the groove 30 is coated a different or contrasting color from the tint of the insert 14 making the coated groove 30 appear to float in the plaque insert 14 giving the insert 14 a three-dimensional visual quality.

It will be apparent to those skilled in the art that modifications may be made without departing from the spirit and scope of the invention. Accordingly, it is not intended that the invention be limited except as may be necessary in view of the appended claims.

What is claimed is:

1. A display plaque comprising:

a base having a front side and a back side and a cavity in said front side, a transparent plaque insert complementary in shape to said cavity having a front surface and a back surface, said plaque insert being fitted in said cavity and attached to said base with said back surface of said plaque insert adjacent to said front side of said base;

a first coating covering said back surface of said plaque insert;

a groove in said back surface of said plaque insert that is visible through the front surface, wherein said groove has a half-moon cross section and comprises a rounded apex; and a second coating inside said groove wherein said first and second coatings comprise different colors to give said plaque insert a three-dimensional appearance.

2. The display plaque of claim 1 wherein said rounded apex is closest to said front surface of said plaque insert.

3. A decorative object for displaying a three-dimensional visual illusion, the object comprising:

a sheet of material having a front side and a back side and being tinted a first color;

a groove formed on the back side of the sheet which is visible to an observer looking through the sheet from the front side thereof;

a first coating of a second color in said groove, said second color being different from said first color giving the sheet a three-dimensional visual illusion to an observer looking at the front side of the sheet; and a base member formed with a recess, the sheet of material being mounted within said recess, with said front side of the sheet facing outwardly therefrom.

4. The decorative object of claim 3 further comprising an adhesive material securing the sheet of material within said recess.

5. A decorative object for displaying a three-dimensional visual illusion, the object comprising:

a sheet of material having a front side and a back side;

a groove formed with a half-moon cross section on the back side of the sheet which is visible to an observer looking through the sheet from the front side thereof; p1 a first coating of a selected color in said groove giving the sheet a three-dimensional visual illusion to an observer looking at the front side of the sheet; and a second coating of a different color from said first coating on said back side of the sheet.

6. The decorative object of claim 5 further comprising a third coating over said first and second coatings.

7. The decorative object of claim 5 further comprising indicia on said front side or said back side of the sheet.

8. The decorative object of claim 5 further comprising a base member formed with a recess, the sheet of material being mounted within said recess, with said front side of the sheet facing outwardly therefrom.

9. A decorative object for displaying a three-dimensional visual illusion, the object comprising:

a sheet of material having a front side and a back side, said back side being either transparent or colored;

a groove formed on the back side of the sheet which is visible to an observer looking through the sheet from the front side thereof;

a first coating of a selected color in said groove, said color of the first coating contrasting with the back side of the sheet of material and giving the sheet a three-dimensional visual illusion to an observer looking at the front side of the sheet.

10. The decorative object of claim 9 wherein the sheet of material is transparent, including the back side thereof.

11. The decorative object of claim 9 further comprising a second coating on the back side of said sheet, said second coating being of a different color from said first coating.

12. The decorative object of claim 9 further comprising indicia on said front side or said back side of the sheet.

* * * * *